US007087202B2

(12) United States Patent
Liu et al.

(10) Patent No.: US 7,087,202 B2
(45) Date of Patent: Aug. 8, 2006

(54) PARTICULATE REINFORCED ALUMINUM COMPOSITES, THEIR COMPONENTS AND THE NEAR NET SHAPE FORMING PROCESS OF THE COMPONENTS

(75) Inventors: Deming Liu, Hong Kong (CN); Chou Kee Peter Liu, Hong Kong (CN); Jian Zhong Fan, Beijing (CN); Jun Xu, Beijing (CN); Tao Zuo, Beijing (CN); Zhao Zu Gao, Beijing (CN)

(73) Assignees: ASM Assembly Automation Ltd. (HK); General Research Institute for Non-Ferrous Metals (CN)

( * ) Notice: Subject to any disclaimer, the term of this patent is extended or adjusted under 35 U.S.C. 154(b) by 0 days.

(21) Appl. No.: 10/628,528

(22) Filed: Jul. 28, 2003

(65) Prior Publication Data

US 2004/0137218 A1 Jul. 15, 2004

(51) Int. Cl.
*B22F 3/12* (2006.01)

(52) U.S. Cl. ..... 419/32; 419/13; 419/14; 419/19; 419/28; 419/33; 419/42; 419/49

(58) Field of Classification Search ..... 75/230, 75/232, 235, 238, 249; 419/10, 12–14, 19, 419/28, 32, 42, 60, 50, 33
See application file for complete search history.

(56) References Cited

U.S. PATENT DOCUMENTS 3,740,210 A * 6/1973 Bomford ..... 75/352
4,060,411 A * 11/1977 Goto et al. ..... 420/533
4,623,388 A * 11/1986 Jatkar et al. ..... 75/232
5,486,223 A * 1/1996 Carden ..... 75/244
5,632,827 A * 5/1997 Fujita et al. ..... 148/688
6,051,045 A * 4/2000 Narula et al. ..... 75/233
6,098,700 A * 8/2000 Carden et al. ..... 164/312
6,250,364 B1 * 6/2001 Chung et al. ..... 164/97
6,630,100 B1 * 10/2003 Murakami et al. ..... 419/12

* cited by examiner

*Primary Examiner*—Ngoclan T. Mai
(74) *Attorney, Agent, or Firm*—Ostrolenk, Faber, Gerb & Soffen, LLP

(57) ABSTRACT

This invention concerns particulate reinforced Al-based composites, and the near net shape forming process of their components. The average size of the reinforced particle in the invented composites is 0.1–3.5 μm and the volume percentage is 10–40%, and a good interfacial bonding between the reinforced particulate and the matrix is formed with the reinforced particles uniformly distributed. The production method of its billet is to have the reinforced particles and Al-base alloy powder receive variable-speed high-energy ball-milling in the balling drum. Then, with addition of a liquid surfactant, the ball-mill proceeds to carry on ball-milling. After the ball-milling, the produced composite powder undergoes cold isostatic pressing and the subsequent vacuum sintering or vacuum hot-pressing to be shaped into a hot compressed billet, which in turn undergoes semisolid thixotropic forming and may be shaped into complex-shaped components. These components can be used in various fields. This product is featured with excellent property, good machinability, stable quality, component near net shape forming and cost effective and higher performance.

15 Claims, 2 Drawing Sheets

PARTICULATE REINFORCED ALUMINUM COMPOSITES, THEIR COMPONENTS AND THE NEAR NET SHAPE FORMING PROCESS OF THE COMPONENTS

FIELD OF THE INVENTION

This invention involves particulate reinforced Aluminium (Al) based composites, their components and the near net shape forming process of the components.

BACKGROUND

Particulate reinforced Al-based composites offer higher specific stiffness and specific strength, good wear-resistance, better fatigue durability, lower thermal expansion coefficient and good dimensional stability, as compared to conventional Al alloys. In addition, the formulas of the composites can be designed in a wide range to meet specific properties, while the conventional Al alloys do not have such capabilities of designability. Therefore, many countries have spent substantial amounts of investments to develop this type of composites, and some of them have been successfully applied in aerospace, military and civilian industries. With the increasing demand for particulate reinforced Al-based composites, fabrication of high performance and cost effective composite components are the focus of current research and development activities. High performance refers to higher mechanical and physical properties with good machinability; while cost effective means to minimize the cost of the composite billets and their final component-forming process cost, especially for the complex components.

At present, four major fabricating processes are used to make particulate reinforced Al-based composite billets, including powder metallurgy (PM), agitation casting, spray forming and squeeze casting. Two key issues to be resolved in the current composite billet fabrication processes are: 1) improvement of the uniformity of the reinforced particle distribution and 2) enhancing their bonding strength in the Al matrix.

It is well-documented that composite properties are controlled by the following key parameters, such as reinforced particle size, their uniformity of distribution, and their interfacial bonding with the matrix. Also, the composite machinability strongly depends on the particle size. Small reinforced particle composites have better machinability. With a view to fabricating high performance and cost effective composites, the desirable parameters include small reinforced particles and uniform distribution, and good interfacial bonding in the matrix. Among the four fabricating processes indicated above, the powder metallurgy (PM) process represents the best one to meet the above parameters. Nevertheless, due to a large particle-size ratio (≧11–28) between the raw Al powder particles (40–100 μm) and the reinforced particles (≦3.5 μm), it is difficult to achieve a uniform distribution of the reinforced particles in the matrix using the conventional mechanical mixing processes. In addition, the surface oxide layer of the Al powder will deteriorate the interfacial bonding strength with the matrix. Thus, high-quality and easy machining composites are hardly fabricated through the ordinary mechanical mixing processes.

U.S. Pat. No. 3,591,362 by Benjamin et. al. provides a theoretical approach to solve this problem. Using a high-energy ball-milling technique, the Al alloy matrix powder particles are deformed repeatedly under grinding and impact by high-energy balls, and a cold-weld layer forms on the ball surface. This cold-weld layer will fall off and be crushed by the continuous work-hardening. Finally, fine composite powers are obtained. Later, U.S. Pat. No. 3,740,210 invented a raw material for the dispersion-strengthened Al composite, consisting of Al powder and its oxide powder. In this process, the raw powders with surfactant are dry-grounded. However, the properties of the composite billet made are deteriorated because the fine composite powders contain the surfactant. Another US patent (U.S. Pat. No. 4,946,500) introduced a method to fabricate Al-based composites, consisting of Al-alloy powder and reinforced particle powder. The raw powders are mixed under a high-energy ball-milling process without adding any surfactant, thus eliminating the negative effect on the properties of the final composite billet. However, cold-welding tends to be more severe during ball-milling without adding surfactant, resulting in an unstable mixing/homogenizing process. Thus, it is not suitable for continuous industrial production. This patent does not specify how to solve the cold-weld problem in case no surfactant is added. In addition, the particle size of the ball-grinding composite powder is too large when surfactant is absent during the milling process. As a result, the billet produced cannot meet requirements in the subsequent compressing forming process.

After acquiring the high performance composite billet fabrication technology, the next key issue is how to reduce the process cost, especially for the complex shape composite components. The near net shape approach is the most cost effective way for making composite components. Machining and mold-forging are the commonly used fabricating methods for components. However, machining would increase the cost due to the composite's poor machinability. Cost of mold forging is also higher because of the composite's poor plastic deformation characteristics.

Semisolid forming components is one of the near net shape forming processes. Thanks to the fine particle size of either the Al matrix powder or the reinforced particles, the composite billet should have a thixotropic characteristic for semisolid processing. A semisolid near net shape forming composite approach has been proven successful using a spray forming composite billet as described in a recent US patent (U.S. Pat. No. 6,135,195). This patent invented a thixotropic composite of SiC/2xxxAl, the composite billet being made by a spray forming process. To ensure the thixotropy of the composite billet, additional Si of 1–5 wt % is added into the standard Al alloy. Also, a well-controlled double heating method is used. However, this patent does not state whether or not this material has its thixotropic nature without adding more Si. Normally, the composite billet prepared by the spray forming process exhibits poor macroscopic distribution of the reinforced particles, and the composite properties are, therefore, not consistent.

SUMMARY OF THE INVENTION

This invention seeks to develop a high-performance, low-cost particulate reinforced Al-based composite and a high-performance, particulate reinforced Al-based composite billet that is easily machinable.

Another object of the present invention is to develop a near net shape forming process for the particulate reinforced Al-base composite components by employing high-energy powder mixing techniques to produce high-performance, particulate reinforced Al-based composite billets that are easily machinable, then near net shape forming components using a semisolid forming technique, and finally, producing high performance and cost effective near net shape forming composite components for industrial applications.

According to a first aspect of the invention, there is provided a type of particulate reinforced Al-based composite which comprises reinforced particles and aluminium alloy, wherein: (1) the reinforced particles are dispersively and uniformly distributed in an aluminum alloy matrix, and forms interfacial bonding with the matrix; (2) the average particle size of the reinforced particles is 0.1–3.5 μm; and (3) the volume percentage of the reinforced particles is 10–40%.

In the preferred embodiment of the invention, the reinforced particulates have high hardness, high elastic modulus and strength and low density. The reinforced particulates may be one of the following: $B_4C$ (boric carbide), SiC (silicon carbide), $Al_2O_3$ (alumina) and AlN (aluminum nitride). The Al matrix alloys may be any of the Al alloys, including one of the following: 2xxx, 6xxx and 7xxx.

According to a second aspect of the invention, there is provided a particulate reinforced Al-based composite component, wherein the component is made from a composite billet of the said particulate reinforced Al-based composite.

According to a third aspect of the invention, there is provided a method of forming a type of particulate reinforced Al-based composite comprising the steps of (1) according to a desired volume percentage of reinforced particles in an Al-based composite, determining a weight percentage of the required reinforced particles; (2) based on the required weight percentage of reinforced particles in the composite, determining a required weight of the reinforced particle and corresponding weight of an aluminum alloy powder; (3) loading required amounts of reinforced particles, Al-based alloy powder and steel balls into a balling drum of a high-energy ball-mill, then carrying out high-energy ball-milling to form a composite powder; (4) adding liquid surfactant, and continuing with ball-milling; (5) molding the composite powder into a desired shape through cold isostatic pressing; (6) processing the cold isostatic pressed shape into a compact billet by means of vacuum sintering or vacuum hot-pressing; then (7) heating the compact billet, and undertaking semisolid die-cast forming to produce a near net shape composite component.

It will be convenient to hereinafter describe the invention in greater detail by reference to the accompanying drawings, which illustrate one embodiment of the invention. The particularity of the drawings and the related description is not to be understood as superseding the generality of the broad identification of the invention as defined by the claims.

DETAILED DESCRIPTION OF THE PREFERRED EMBODIMENT

Figure 1:
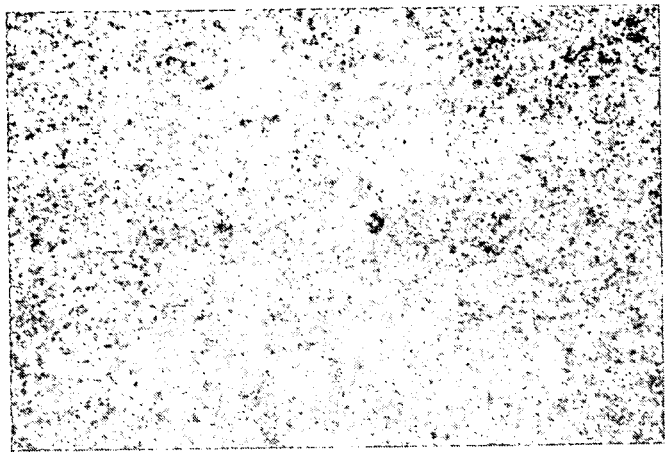
FIG. 1 shows the optical metallographic structure (×200) of Composite AlN/6061 after a 6-hour high-energy ball-milling (AlN powder and 6061 alloy powder)

The preferred embodiment of a method of producing the components of particulate reinforced Al-based composites according to the invention involves the following steps: 1) A volume percentage of 10–40% of the reinforced particles (an equivalent weight percentage of 9.3–50.9%) in the composite is determined; then according to the weight percentage of reinforced particles, the weight of the required reinforced particles and the balanced raw Al-base alloy powder can be calculated; 2) load the required volume of reinforced particles, Al-alloy powder required and the steel balls into a balling drum, and variable-speed high-energy ball-milling undertaken from 1–10-hours. The weight ratio between the steel balls and the powder is 10–50:1; the rotational speed of the high-energy ball-mill is arranged into two stages: first a low speed stage, then a high-speed stage. At the low-speed ball-milling stage, the rotational speed is 100–150 rpm, milling for 10–40 minutes; while at the high-speed ball-milling stage, the speed is 150–300 rpm, milling for 20–600 minutes; 3) adding a liquid surfactant and ball-milling for 0.5–2 hours in a temperature range of 15–80° C. The weight ratio between the balls and the powder is 10–50:1, and the rotational speed of the high-energy ball-milling is 100–300 rpm. The composite powders are produced through steps 1) to 3); 4) the composite powders are further subjected to a cold isostatic pressing to form a green billet under a pressure of 200–1000 MPa for 1–10 minutes. The green billet is 70–80% of the theoretical density; and 5) hot compressing the green billet into a dense billet by a vacuum-sintering or a hot-forming process at a temperature of 450–600° C., under a pressure of 36–70 MPa and a vacuum of no less than $1.5\times10^{-2}$ Pa; and 6) double heating the dense billet at 600–660° C., and when reaching a liquid-phase content of 60–70%, undertaking semisolid squeeze or die casting for near net shape forming the composite components.

At step 2, high-carbon steel balls with a diameter of Φ5–Φ8 mm are considered optimal. The average particle size ratio between the reinforced particles and the Al-based alloy powder can be selected within a wide range. The average size of the reinforced particles is greater than 0.1 μm and the average size of the Al-based alloy powder is larger than 10 μm. The particle size ratio (reinforced/matrix) can be selected within the following range: 0.1–100 μm/10–210 μm.

In the component fabricating process, the designed 10–40% volume percentage content (9.3–50.9% weight percentage) of the reinforced particles, and the balanced Al matrix powder is prepared. The reinforced particles with an average particle size of 0.1–100 μm and the Al alloy powders of 10–210 μm will be used; mixing the powders with Φ5–Φ8 mm high-carbon steel balls and loading them into a balling drum, under a 0.1–10 Pa vacuum, followed by filling an inert gas (preferably nitrogen or argon). The pressure of the filled nitrogen or argon is $1.01\times10^5$ Pa–$1.1\times10^5$ Pa. The balling drum is water-cooled to 25° C., starting variable-speed high-energy ball-grinding for 1–10 hours. The rotation speed of the high-energy ball-mill is divided into a low-speed range of 100–150 rpm for 10–40 minutes, and a high-speed of 150–300 rpm for 20–600 minutes, respectively. The variable-speed high-energy ball-milling helps to avoid cold-welding without adding surfactant, and thus, to ensure a smooth milling process. After ball-milling, first add 10–50 ml liquid surfactant, under a vacuum of 0.1–10 MPa, then fill with nitrogen or argon gas at a pressure of $1.01\times10^5$ Pa–$1.1\times10^5$ Pa. In the condition of no water cooling, the mixed powders can be ground into 10 to 120 μm after high energy balling about 0.5 to 2 hours at 15–80° C. Pack and seal the composite powder in a vacuum rubber package and subject it to cold isostatic pressing at a pressure of 200–1000 MPa for 1–10 minutes. The formed green composite billet reaches 70–80% of its theoretical density. The green billet is hot compressed into a compact billet through a vacuum-sintering or a hot-pressing at 450–600° C., under a pressing pressure of 36–70 MPa and a vacuum of no less than $5\times10^{-2}$ Pa. The compact billet is finally heated at 600–660° C. in a specially-designed induction furnace, preferably by double-heating. When a liquid-phase content reaches about 60–70% in the matrix, it is ready for the semisolid squeeze casting process. The volume of the added surfactant in the milling process is 10–50 ml. The surfactant can be any of the following organic solvents, such as gasoline, aviation gasoline, methanol or ethanol. At step 3, the weight ratio between the steel balls and the total weight of reinforced particles and Al-alloy powder is 10–50:1, and the rotational speed is 100–300 rpm.

The average size of the reinforced particle is one of the key factors affecting the overall properties of the composite. In general, large-sized particles (>3.5 μm) help to improve the elastic modulus and strength but reduce the plasticity significantly. On the contrary, small-sized particles (<3.5 μm) and submicron particles are capable of maintaining a high plasticity and ductility, and also increase the elastic modulus and strength, which is favorable to the secondary process and machinability. The average reinforced particle size can be controlled within the range of 0.1–1 μm. FIG. 1 shows the particulate reinforced composite with an average particle size of 1.5 μm after 6 hours balling. The following parameters will affect the reinforced particle average size, including the weight ratio between the steel balls and two types of feed powders (the ball-powder ratio), the rotational speed, and the high-energy ball-milling time. The high performance composite powders can be obtained using the following parameters, including a larger ball-powder ratio, a 180–300 rpm high rotation speed and a longer ball-milling time of 4–10 hours. In the ball-milling mixing process mentioned above, the ball-powder ratio can be chosen in a range of 10–50:1, however, a range of 20–50:1 is more preferable.

At Steps 2 and 3, the ball-powder ratio is the ratio between the weight of steel balls and the total weight of reinforced particles and the Al alloy powder, and selection of a specific ball-powder ratio depends on the requirements for the average size of reinforced particle and the ball-milling time: the smaller the average size of reinforced particles, the greater the ball-powder ratio; the shorter the ball-milling time, the greater the ball-powder ratio. In steps 2 and 3, the rotation speed of the high-energy ball-mill can be chosen from 100–300 rpm. A speed range of 180–300 rpm is more preferable. In step 2, the rotation speed of high-energy ball-milling is 150–300 rpm, and a range of 180–300 rpm is more preferable. The specific rotation speed mostly depends on the requirements for the average size of reinforced particle and the ball-milling time: the smaller the average size of reinforced particle, the higher the rotation speed needed; the shorter the ball-milling time, the higher the rotation speed required. In addition, the rotation speed must be appropriate to prevent powder from adhering.

During the step 2 ball-milling process, a variable-speed high-energy ball-milling is implemented to prevent the adhesion of Al-based alloy powder. Initially, a low-speed high-energy ball-milling is used to achieve the work hardening of the Al-based alloy powder, then a high-speed high-energy ball-milling is adopted to make composite powders.

With the addition of surfactant, the composite power can be crushed rapidly, and to allow its average particle size to meet the requirements of the subsequent forming process, the particle size of the composite powder should be in the range of 10–120 μm.

Figure 2A:
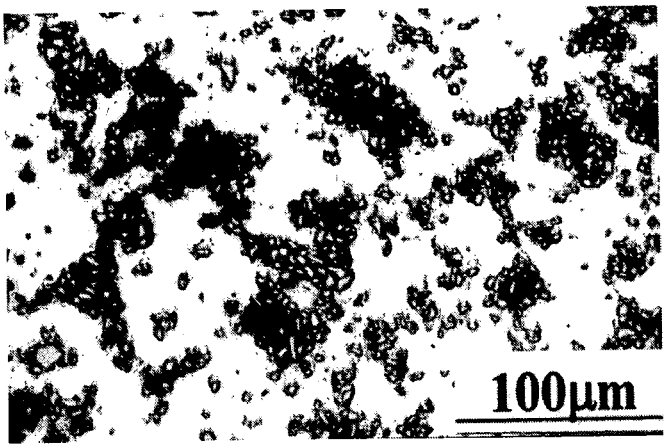
FIG. 2*a* shows the particle distribution of $B_4C$ after common mechanical mixing.
Figure 2B:
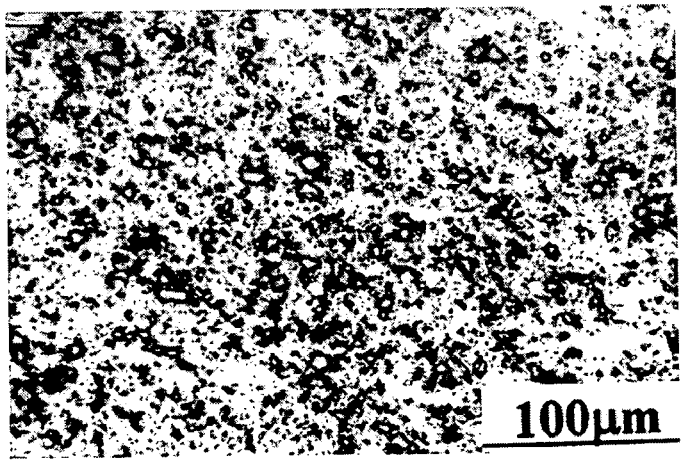
FIG. 2*b* shows the particle distribution of $B_4C$ after high-energy ball-milling.

The uniform distribution of reinforced particles in the matrix is a major issue to be resolved in the preparation of composites. When using the commonly used mechanical mixing, the reinforced particle distribution uniformity is mainly controlled by the physical properties of the material constituents contained, while the disparity in their physical properties will result in poor uniformity of distribution of reinforced particles. On the contrary, a good uniformity can be obtained by a high-energy ball-milling process, when the ball-powder ratio, the rotation speed and the ball-milling time are well controlled. As a result, the disadvantages caused by the physical property disparities of composite constituents can be avoided. Additionally, the high-energy ball-milling process can also help to achieve uniform distribution of the submicron reinforced particles. As shown in FIG. 2, the results of mechanical mixing and high-energy ball-milling on distributional uniformity are compared, and the latter is obviously superior to the former in particle distributional uniformity. Furthermore, smaller particle size leads to better uniformity. The appropriate ball-powder ratio, the suitable rotation speed and the right ball-milling time are the key factors for obtaining uniform distribution of reinforced particles in the matrix.

The interfacial bonding strength between the matrix and the reinforced particles is an important factor affecting the composite property. Forming a high interfacial bonding strength is a crucial stage in producing sound composites. Under the conventional mechanical-mixing powder metallurgy process, the existence of an oxide layer on the Al-base alloy powder is harmful to the bonding strength. The high-energy ball-milling technique adopted in this invention overcomes the flaws in the aforementioned process, laying a solid foundation for a well-controlled and well-bonded interface.

Figure 3:
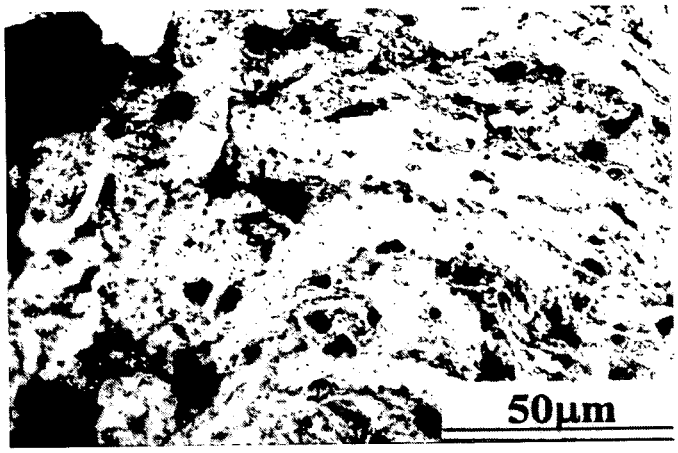
FIG. 3 shows the cold-welding stripes in the $B_4C$/6061 composite powder.

In the invented particulate reinforced Al-based composite, the reinforced particle is uniformly distributed in the Al-based alloy matrix. During high-energy ball-milling, the Al-base alloy powders are formed through steel ball grinding and impact. Meanwhile, the brittle reinforced particles are crushed and compressed with the deformed Al powder and form a cold welded layer on the steel ball surface. Due to continual work hardening, the cold-welding layer formed on the steel ball surface will fall off from the balls and crushed and cold-welded again. Through this repeating process, the fine reinforced particle is mechanically embedded and dispersively distributed into the Al-alloy powders. FIG. 3 shows the cold-welding stripes in the composite powders. Deformation of the Al-based alloy powder, the appearance of cold-welding, and relative uniform distribution of the reinforced particle can be seen.

At Step 4, the density of the green compacted billet is about 70–80% of its theoretical value, to ensure the linkage of the air-gaps between powders for the next vacuum degassing.

At Step 5, either using vacuum sintering or vacuum hot-pressing, vacuumizing and heating are simultaneously carried out, finally heating at 450–600° C. (the specific heating temperature depends on the specific types of matrix powder) under a vacuum of $10^{-2}$ Pa. Vacuum degassing is used to remove residual gas of the green billet, and the adsorbent water or chemical crystal water and other volatile substances attached on the powders.

Figure 4:
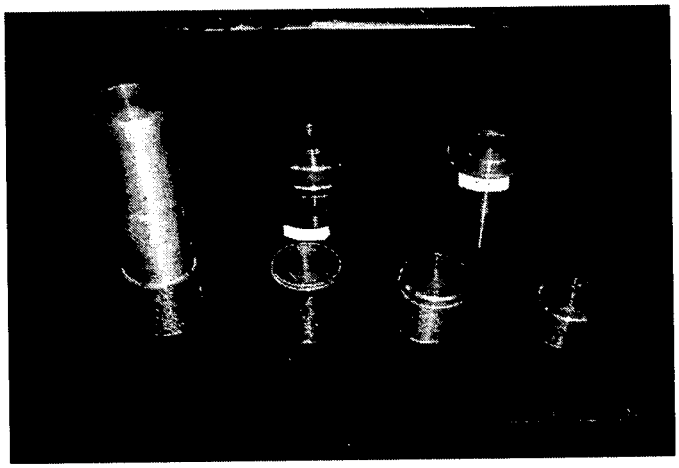
FIG. 4 shows a vacuum hot-pressed billet made from composites of 35vol%AlNp/6061Al and 35vol%SiCp/6061Al.
Figure 5:
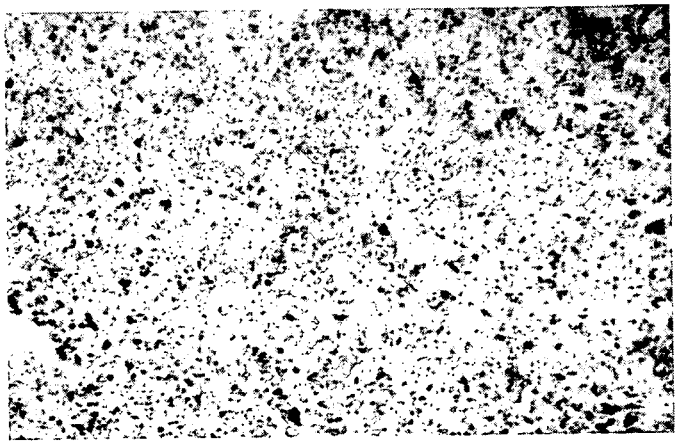
FIG. 5 shows the optical microcosmic structure (×500) of a thixotropic composite SiCp/A1.

The high cost of composite component fabrication is another key factor limiting their applications. Traditional component forming processes, such as hot extrusion, mold forging and machining can still be applicable for the particulate reinforced Al-base composite. However, the cost is very high as compared with Al conventional alloys due to the composite's poor plasticity and machinability, thus limiting the composite's applications. If the composite billet is fully machined into a complex shape component, the cost is extremely high because of machining tooling easily wearing off, much longer machining time required and expensive composite material machined off. Traditional near net shape approaches, such as forging or hot extrusion are not suitable for the composite component forming, due to their poor plastic deformation nature. Step 6 adopts a semisolid near net shape forming technique to fabricate complex-shaped particulate reinforced Al-based composite components. Taking advantage of the thixotropy characteristics of the composite billets and applying a double heating procedure, when the co-existence of solid and liquid phases is obtained, the compact billet can be easily semisolid squeeze casted. This near net shape semi-solid forming process significantly increases the yield of composite material used for fabrication of composite components. Meanwhile, much less machining is required. FIG. 4 shows a vacuum hot-pressed composite billet: 35vol%AlNp/6061Al and 35vol%SiCp/6061Al. FIG. 5 shows the microcosmic structure of a thixotropic composite.

The advantages of this invented particulate reinforced Al-base composite and its component forming process include the following:

1. The reinforced particles uniformly distribute in the matrix with a good interfacial bonding in the matrix, ensuring superior mechanical properties in terms of high strength and high stiffness. Table 1 displays the properties of several high-performance composites. In addition, by controlling the reinforced particle size range, good machinability can be obtained.
2. The invented composite billet fabrication is a simple process and the ball-milling time is significantly reduced, resulting in a short production cycle. In the ball-milling process, no surfactant is added, avoiding deterioration of the material properties. The adoption of a variable-speed high-energy ball-milling technique effectively avoids the severe powder cold-welding. Only a small amount of surfactant is added in the ball milling process. At a given temperature range, composite powder crushing is accelerated by vaporization of the surfactants and a composite powder with an appropriate particle size is formed.
3. The invented composite billet fabricating process easily improves the average size and surface chemical condition of the reinforced particles as well as their uniform distribution in the matrix. It reduces the negative effects resulting from the physical property disparity of the raw material constituents, to form good interface bonding between the reinforced particles and the matrix. A well-controlled average particle size and uniform distribution of particles, especially the uniform distribution of submicron particles in the Al matrix, can be obtained by this process.
4. The semisolid forming technology is invented for making the near net shape composite components, hence greatly increasing the yield of composite billets, reducing the machining time, resulting in an overall cost reduction of composite components
5. This invention organically combines the high-energy ball-milling powder metallurgy technology having a capability of producing high-performance composite billets, with the semisolid near net shape forming technology of components. It takes full advantage of the high-energy ball-milling technique with uniform distribution of small-sized particles and sound interfacial bonding with the matrix, thus ensuring that the composite billets having high performance and good machinability. The semisolid near net shape forming process described in the present invention is a more cost effective way for fabricating complex components. As described above, by adopting the two new processes i.e. the high energy balling/milling and the semisolid process, high performance and cost effectiveness of particulate reinforced Al-base composite components can be obtained.

TABLE 1

Properties of High-performanc Composites

| Name of composites | Tensile Strength (MPa) | Yield strength (MPa) | Elastic Modulus (Gpa) | Elongation (%) | Fracture reduction area (%) |
|---|---|---|---|---|---|
| 17vol % $B_4Cp$/6061Al (T6) | 470 | 415 | 108 | 2 | — |
| 15vol % SiCp/2024Al (T6) | 513 | 453 | 100 | — | 3.3 |
| 35vo1 % AlNp/6061Al (R) | 495 | — | — | — | — |

Among of the three composites, the manufacturing method of Composite 17vol%$B_4Cp$/6061Al (T6) is demonstrated in Sample case 1.

SiC reinforced particles and 2024 Al matrix are used in composite 15vol%SiCp/2024Al (T6). The volume percentage of SiC particles is 15%. Composite 35vol%AlNp/6061Al (R) consists of AlN reinforced particles and 6061Al Aluminum alloy. The volume percentage of AlN particles is 35%. These composites are all made by the present invented processes.

Sample Cases

To further illustrate this invention and for a better understanding of the invented products, its fabricating process involved and advantages, several sample cases are shown below.

Sample Case 1

A composite $B_4Cp$/6061Al consists of the reinforced $B_4C$ particle with an average size of 0.92 μm, volume percentage of 17%, and the reinforced particles are uniformly distributed in the Al-alloy matrix.

The production method is: 1) selection of a volume percentage of 17% of the $B_4C$ particles (weight %: 18.1%); 2) weigh 543 grams of $B_4C$ powder of 0.92 μm, and 2457 grams of 6061Al powder of 105 μm, respectively, and 50 kilograms of 6 mm high-carbon steel balls, then load all of them into a balling drum and seal the charging door tightly; 3) vacuumize to $5\times10^{-1}$ Pa, then fill in an inert gas nitrogen at the pressure of $1.02\times10^{5}$ Pa; 4) ball milling at 15~25° C. under water cooling, the balling drum undertakes a 0.5-hour high-energy ball-milling at an initial rotation speed of 125 rpm; then proceeds for a 2-hour ball-milling at an escalated rotation speed of 192 rpm; 5) at the end of the ball-milling, add 20 ml methanol, vacuumize to $5\times10^{-1}$ Pa, then fill nitrogen gas until the pressure reaches $1.02\times10^{-5}$ Pa; 6) under the condition of no water cooling, ball mixing for 0.5-hour in the high-energy ball-milling stage at 15–80° C. with a rotation speed of 125 rpm; 7) discharge the powders when ball-milling is finished. The average particle size of the produced composite powder is 70.6 μm, with uniformly distribution of $B_4C$ particle of 0.92 μm 8) feed and seal the composite powder in a 120 mm×300 mm vacuum rubber package, place it in the hydro-cylinder, and subject it to cold isostatic pressing under a pressure of 200 MPa holding for 3 minutes. The density of the green billet is 75% of its theoretical density; 9) the green billet is further hot compacted under a vacuum ($3\times10^{-2}$ Pa) hot-pressing under 42 Mpa at 550° C., 10) finally, load the compact billet into a specially-designed induction furnace and double heat to 650° C., when reaching a 60–70% liquid-phase content, carry out the semisolid squeeze casting. The properties of this near net shape composite billet are shown in Table 1.

Sample Case 2

The composite of SiCp/2024Al consists of a volume percentage of 15% of SiC particle of 3.5 μm in diameter.

The production method is as follows: 1) a 15% volume of the SiC particle (wt % of 17.3) and 2024 Al matrix powders are prepared, 2) weigh 519 grams of SiC powder of 3.5 μm, 2481 grams of 2024Al powder of 75 μm, and 40 kilograms of 6 mm high-carbon steel balls, respectively, then load them all into a balling drum and seal the charging door tightly; 3) vacuumize to $5\times10^{-1}$ Pa, then fill in nitrogen gas, until a pressure of $1.02\times10^{5}$ Pa is reached; 4) under water cooling at 15 ~25° C., high-energy ball-milling for 0.5-hour at an initial rotation speed of 125 rpm; then proceed with a 2-hour ball-milling at a higher speed of 192 rpm; 5) at the end of the ball-milling, add 10 ml methanol, vacuumize to $5\times10^{-1}$ Pa, then fill with nitrogen, until the pressure reaches $1.02\times10^{5}$ Pa; 6) under a condition without water cooling, high-energy ball-milling at a rotational speed of 125 rpm for 0.5 hour at a temperature range of 15–80° C.; 7) discharge the powders when the ball-milling terminates. The average particle size of the composite powder is 35 μm, and the SiC particles (3.5 μm in average diameter) uniformly distribute in the composite powder; 8) feed and seal the composite powder in a 120 mm×250 mm vacuum rubber package, followed by placing it into a hydro-cylinder, then cold isostatic pressing at a pressure of 200 MPa, holding for 3 minutes. The density of the green billet is 74% of the theoretical density; 9) the green billet is further hot compacted in a vacuum ($3\times10^{-2}$ Pa) hot-press at 510° C. under a 42 Mpa pressure; 10) finally, load the compacted billet into a specially-designed induction furnace and carry out double heating to 610° C., when reaching a 60–70% liquid-phase content, proceed to semisolid squeeze casting.

Sample Case 3

SiCp/6061Al consists of uniformly distributed 35 vol % SiC particles (3.5 μm) and 6061Al matrix powder.

The production method: 1) a 35 vol. % of SiC particles (31.2 wt %) and the 6061Al matrix are prepared; 2) weigh 1248 grams of SiC powder of 3.5 μm, 2752 grams of 6061Al powder of 105 μm, and 40 kilograms of 6 mm high-carbon steel balls, respectively, then load all of them into a balling drum; 3) vacuumize to $5\times10^{-1}$ Pa, then fill with nitrogen gas, until reaching a pressure of $1.02\times10^{5}$ Pa; 4) under water cooling at 15~25° C., high-energy ball-milling for 1-hour at an initial rotation speed of 125 rpm; then proceeds 4-hour ball-milling at a high rotation speed of 192 rpm; 5) at the end of the ball-milling, add 10 ml of methanol, vacuumize to $5\times10^{-1}$ Pa, then fill with nitrogen, until the pressure reaches $1.02\times10^{5}$ Pa; 6) under the condition of no water cooling, high-energy ball-milling in a temperature range of 15–80° C. with a rotation speed of 125 rpm; 7) discharge the powders when the ball-milling terminates; 8) feed and seal the composite powders in a 120 mm×250 mm vacuum rubber package, place it in a hydro-cylinder and subject it to cold isostatic pressing at 500 MPa, holding for 3 minutes. The density of the green billet is 70% of its theoretical density; 9) the green billet is then further hot compacted by vacuum ($3\times10^{-2}$ Pa) hot-pressing at 550° C. under a pressure of 42 MPa; 10) load the compacted billets into a specially-designed induction furnace and carry out double heating to 660° C., when a 60–70% liquid-phase content is obtained, then proceed to semisolid squeeze casting.

The invention described herein is susceptible to variations, modifications and/or additions other than those specifically described and it is to be understood that the invention includes all such variations, modifications and/or additions which fall within the spirit and scope of the above description.

The invention claimed is:

1. A method of forming a particulate reinforced aluminum-based composite component comprising the steps of:

(1) according to a desired volume percentage of reinforced particles in an aluminum-based composite, determining a weight percentage of the required reinforced particles;

(2) based on the required weight percentage of reinforced particles in the composite, determining a required weight of the reinforced particle and corresponding weight of an aluminum alloy powder;

(3) loading required amounts of reinforced particles, Al-based alloy powder and steel balls into a balling drum of a high-energy ball-mill, then carrying out high-energy ball-milling to form a composite powder wherein the high-energy ball-milling is divided into a low speed stage wherein a rotational speed is 100–150 rpm for 10–40 minutes, and a high speed stage wherein a rotational speed is 150–300 rpm for 20–600 rpm;

(4) adding liquid surfactant, and continuing with ball-milling;

(5) molding the composite powder into a desired shape through cold isostatic pressing;

(6) processing the cold isostatic pressed shape into a compact billet by means of vacuum sintering or vacuum hot-pressing; then (7) heating the compact billet, and undertaking semisolid die-cast forming to produce a near net shape composite component.

2. A method as claimed in claim 1, wherein the volume percentage of reinforced particles is 10–40% and the weight percentage of reinforced particles is 9.3–50.9%.

3. A method as claimed in claim 1, wherein high-energy ball-milling is performed for 1–10 hours and a ball powder weight ratio is 10–50:1.

4. A method as claimed in claim 1, wherein after adding liquid surfactant, ball-milling is continued for 0.5–2 hours within a temperature range of 15–80° C.

5. A method as claimed in claim 1, wherein the compact billet has a density of 70–80% of its theoretical density, and is formed by applying a pressure of 20–1000 Mpa for 1–10 minutes.

6. A method as claimed in claim 1, wherein the vacuum sintering or vacuum hot-pressing is carried out at a temperature of 450–600° C., pressure of 36–700 Mpa and vacuum degree of not less than $1.5\times10^{-2}$ Pa.

7. A method as claimed in claim 1, wherein the compact billet is heated to 600–660° C. to reach a 60–70% liquid phase content.

8. A method as claimed in claim 1, wherein the reinforced particle is selected from the group consisting of $B_4C$, SiC, $Al_2O_3$ and AlN.

9. A method as claimed in claim 1, wherein the average size of the reinforced particle can be selected within a range of 0.1–100 μm and the Al-base alloy powder can be selected within a range of 10–210 μm.

10. A method as claimed in claim 1, wherein the steel balls are high-carbon steel balls having a diameter 5–8 mm.

11. A method of forming a particulate reinforced aluminum-based composite component comprising the steps of:

(1) according to a desired volume percentage of reinforced particles in an aluminum-based composite, determining a weight percentage of the required reinforced particles;

(2) based on the required weight percentage of reinforced particles in the composite, determining a required weight of the reinforced particle and corresponding weight of an aluminum alloy powder (3) loading required amounts of reinforced particles, Al-based alloy powder and steel balls into a balling drum of a high-energy ball-mill, then carrying out high-energy ball-milling to form a composite powder; wherein the balling drum is first vacuumized to a vacuum degree of 0.1–10 Pa, then an inert gas of nitrogen or argon is added at a pressure of $1.01\times10^5$ Pa, and the balling drum undertakes high-energy ball-milling with cooling of 5–25° C.

(4) adding liquid surfactant, and continuing with ball-milling;

(5) molding the composite powder into a desired shape through cold isostatic pressing;

(6) processing the cold isostatic pressed shape into a compact billet by means of vacuum sintering or vacuum hot-pressing; then (7) heating the compact billet, and undertaking semisolid die-cast forming to produce a near net shape composite component.

12. A method of forming a particulate reinforced aluminum-based composite component comprising the steps of:

(1) according to a desired volume percentage of reinforced particles in an aluminum-based composite, determining a weight percentage of the required reinforced particles;

(2) based on the required weight percentage of reinforced particles in the composite, determining a required weight of the reinforced particle and corresponding weight of an aluminum alloy powder;

(3) loading required amounts of reinforced particles, Al-based alloy powder and steel balls into a balling drum of a high-energy ball-mill, then carrying out high-energy ball-milling to form a composite powder wherein during the ball-milling process, the balling drum is first vacuumized to a vacuum degree of 0.1–10 Pa, then an inert gas of nitrogen or argon is added at a pressure of $1.01\times10^5$ Pa~$1.1\times10^5$ Pa, and the balling drum undertakes high-energy ball-milling without cooling;

(4) adding liquid surfactant wherein the amount of the added surfactant is 10–50 ml, and continuing the ball-milling;

(5) molding the composite powder into a desired shape through cold isostatic pressing;

(6) processing the cold isostatic pressed shape into a compact billet by means of vacuum sintering or vacuum hot-pressing; then (7) heating the compact billet, and undertaking semisolid die-cast forming to produce a near net shape composite component.

13. A method as claimed in claim 1, wherein the particle size range of the composite powder after the high-energy ball-milling is 10–120 μm.

14. A method as claimed in claim 1, wherein the added surfactant is an organic solvent selected from the group consisting of gasoline, aviation gasoline, methanol and ethanol.

15. A method as claimed in claim 1, wherein the compact billet is shaped by means of semisolid die-casting after it is heated.

* * * * *